US007269973B2

(12) United States Patent
Koren

(10) Patent No.: US 7,269,973 B2
(45) Date of Patent: Sep. 18, 2007

(54) ETERNITY BAND WITH U-SHAPED SEATS FOR GEMSTONES

(76) Inventor: Daniel Koren, 555 Madison Ave., New York, NY (US) 10022

( * ) Notice: Subject to any disclaimer, the term of this patent is extended or adjusted under 35 U.S.C. 154(b) by 111 days.

(21) Appl. No.: 11/118,819

(22) Filed: Apr. 29, 2005

(65) Prior Publication Data

US 2006/0254313 A1 Nov. 16, 2006

(51) Int. Cl.
*A44C 9/00* (2006.01)

(52) U.S. Cl. ..... 63/15; 63/28

(58) Field of Classification Search ..... 63/15, 63/26–28; D11/89–92, 34, 37, 38
See application file for complete search history.

(56) References Cited

U.S. PATENT DOCUMENTS 1,032,025 A * 7/1912 Robbins ..... 63/28
D119,052 S * 2/1940 Sherman ..... D11/34
D119,506 S * 3/1940 Sherman ..... D11/34
D120,129 S * 4/1940 Mann ..... D11/34
D121,128 S * 6/1940 Schaeffer ..... D11/91
2,261,958 A * 11/1941 Burri ..... 63/32
D152,253 S * 1/1949 Gaertner ..... D11/7
5,419,159 A * 5/1995 Muller ..... 63/28
D520,397 S * 5/2006 Rives ..... D11/34

* cited by examiner

*Primary Examiner*—Jack W. Lavinder
(74) *Attorney, Agent, or Firm*—Ezra Sutton, Esq.

(57) ABSTRACT

An eternity band having a multi-stone circular setting in combination with gemstones or diamonds. The circular setting includes a plurality of U-shaped seats being connected in series to form a circular configuration; and each of the U-shaped seats form a seating area for receiving and mounting a gemstone therein. Each of the U-shaped seats include an inner U-shaped member and an outer U-shaped member. A plurality of the inner U-shaped members is connected in series to form an inner wall; and a plurality of the outer U-shaped members is connected in series to form an outer wall. Each of the inner and outer U-shaped members has two upstanding prongs which are shared with an adjacent U-shaped seat for holding adjacent gemstones so the side wall surfaces of adjacent gemstones touch each other and provide a continuous appearance. Each of the upstanding prongs are bent inwardly for engaging the side wall surfaces of two adjacent gemstones to keep the gemstones seated within the seating areas. Each of the inner and outer U-shaped members are connected by two transverse support bars on which each gemstone is seated in the seating area to support it from below.

6 Claims, 5 Drawing Sheets

ETERNITY BAND WITH U-SHAPED SEATS FOR GEMSTONES

FIELD OF THE INVENTION

The present invention relates to an eternity band having a setting for holding a plurality of diamonds or gemstones within the setting. More particularly, this setting includes a series of U-shaped seats each for mounting a separate diamond or gemstone, using shared prongs in order to minimize the structure and support of the setting.

BACKGROUND OF THE INVENTION

Eternity bands are known in the art where the setting typically has seats with four prongs for each seat to mount in the setting. Thus, such settings with four prongs per seat and gemstone do not allow the maximum visibility of each gemstone. It would be desirable to minimize the structure and support of the setting to increase the visibility of the gemstones in an eternity band.

Therefore, there remains a need for a novel setting for an eternity band having multiple gemstones and seats which overcomes the disadvantages of conventional gemstone settings for eternity bands. Such a novel setting would include a series of connected U-shaped seats each for mounting a separate diamond or gemstone, using shared prongs in order to minimize the structure of the setting and to maximize the visibility of the gemstones in a setting of an eternity band.

When using shared prongs in a setting, it is difficult to construct because the adjacent gemstones must touch each other and have no space between them, so that two adjacent gemstones can be supported by sharing the same two prongs where the adjacent gemstones touch each other. In a typical four prong setting for each seat, adjacent gemstones do not have to touch each other, since each gemstone is supported by its own set of four prongs, and they can be adjusted to compensate for spaces between adjacent gemstones.

DESCRIPTION OF THE PRIOR ART

Gemstone settings, multi-gemstone settings, jewelry settings and the like having various designs, structures, configurations and functions have been disclosed in the prior art. For example, U.S. Pat. No. 5,848,539 to OUZOUNIAN discloses a multiple precious stone setting for mounting two or more rows of round-shaped precious stones. This prior art patent does not disclose the structure and configuration of the present invention.

U.S. Pat. No. 5,520,017 to VIVAT discloses jewelry items with gemstone settings, wherein the gemstone setting includes at least two walls so as to provide at least one groove. The groove slidably receives one or more rectangularly-shaped precious stones therein. This prior art patent does not disclose the structure and configuration of the present invention.

U.S. Pat. No. 5,123,265 to RAMOT discloses a gemstone setting which includes one or more gemstones and a setting having a base formed with a plurality of ribs defining one or more sockets of polygonal configuration for receiving the gemstones; This prior art patent does not disclose the structure and configuration of the present invention.

U.S. Pat. No. Des. D403,611 to LAI discloses an ornamental design for a jewelry setting having a square-shaped pattern for square-shaped gemstones. This prior art patent does not disclose the structure and configuration of the present invention.

U.S. Pat. No. 6,003,335 to GUREVICH et al. discloses a multi-stone center setting for receiving therein four or six rectangular-shaped or square-shaped gemstones which gives the appearance of a single gemstone. This prior art patent does not disclose the structure and configuration of the present invention.

U.S. Pat. No. 6,442,971 to GUREVICH discloses a multi-stone round center setting for receiving therein six triangular-shaped diamonds or gemstones which gives the appearance of a single round gemstone. This prior art patent does not disclose the structure and configuration of the present invention.

U.S. Pat. No. 6,453,700 to AVRIL discloses a multi-stone setting member for receiving therein six rectangular-shaped or square-shaped gemstones which gives the appearance of a single gemstone. This prior art patent does not disclose the structure and configuration of the present invention.

None of the aforementioned prior art patents disclose or teach an eternity band having a multiple gemstone circular setting for holding and mounting therein a plurality, of diamonds or gemstones, wherein the setting includes a series of connected U-shaped seats each for mounting a separate diamond or gemstone, using shared prongs to support adjacent gemstones in order to minimize the support structure of the setting and to maximize the visibility of the gemstones in the setting of an eternity band.

Accordingly, it is an object of the present invention to provide a novel multi-stone circular setting for an eternity band which is used for holding and mounting a plurality of diamonds or gemstones within the setting.

Another object of the present invention is to provide a multi-stone circular setting for an eternity band that includes a series of connected U-shaped seats, each seat for mounting a separate diamond or gemstone, using shared prongs in order to minimize the support structure of the setting.

Another object of the present invention is to provide a multi-stone circular setting for an eternity band that can be made from precious metals such as gold, silver, platinum or palladium for setting precious gemstones including diamonds, rubies, sapphires, emeralds and the like.

Another object of the present invention is to provide a multi-stone circular setting for an eternity band that can be produced in an economical manner and is readily affordable by the jewelry consumer.

SUMMARY OF THE INVENTION

In accordance with the present invention, there is provided an eternity band having a multi-stone circular setting in combination with gemstones or diamonds. The circular setting includes a plurality of U-shaped seats being connected in series to form a circular configuration; and each of the U-shaped seats form a seating area for receiving and mounting a gemstone therein. Each of the U-shaped seats include an inner U-shaped member and an outer U-shaped member. A plurality of the inner U-shaped members is connected in series to form an inner wall; and a plurality of the outer U-shaped members is connected in series to form an outer wall. Each of the inner and outer U-shaped members has two upstanding prongs which are shared with an adjacent U-shaped seat for holding adjacent gemstones so the side wall surfaces of adjacent gemstones touch each other and provide a continuous appearance. Each of the upstanding prongs are bent inwardly for engaging the side wall surfaces of two adjacent gemstones to keep the gemstones seated within the seating areas. Each of the inner and outer U-shaped members are connected by two transverse support bars on which each gemstone is seated in the seating area to support it from below.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
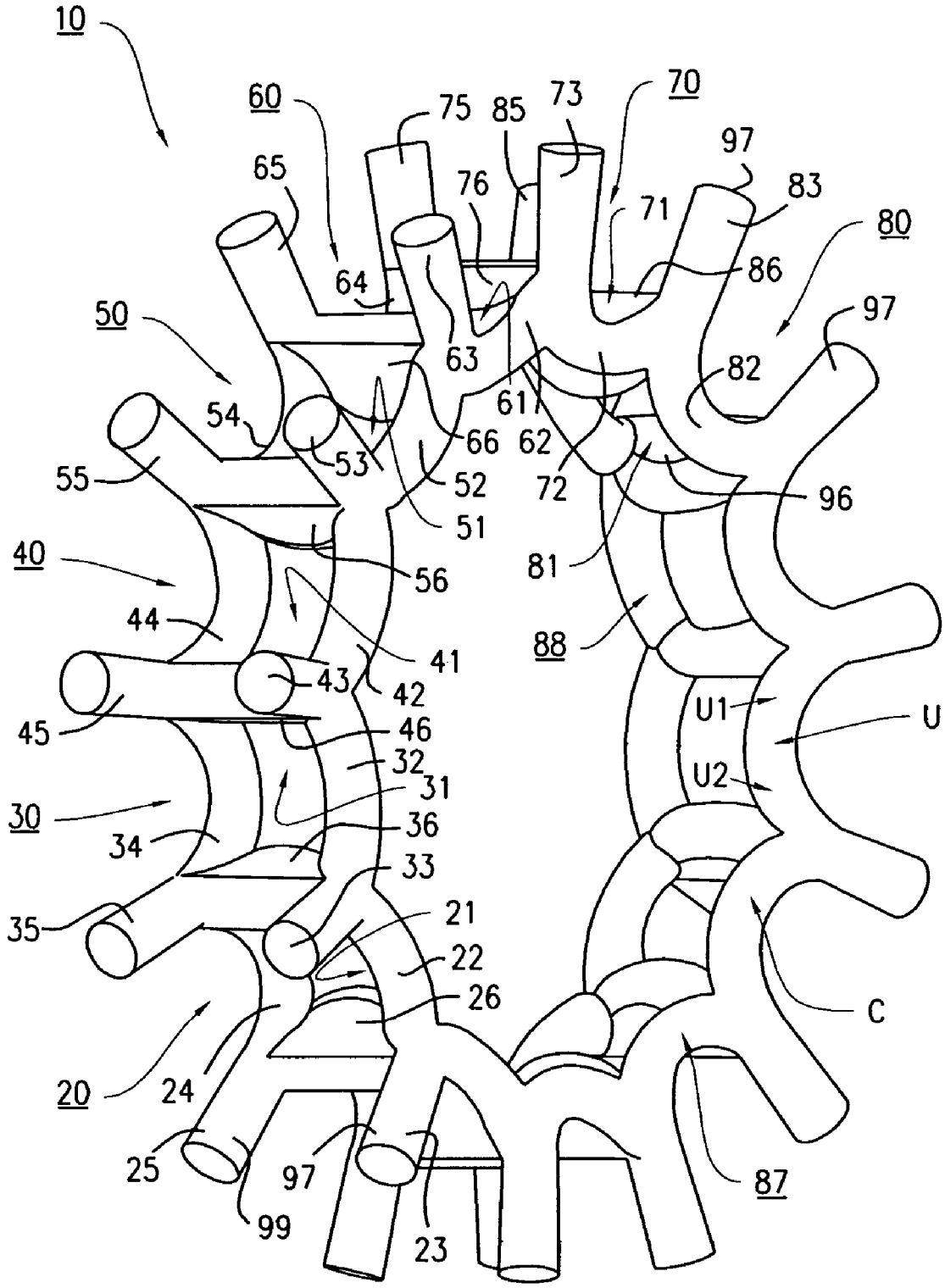
FIG. 1 is a front perspective view of the multi-stone circular setting for an eternity band of the preferred embodiment of the present invention showing a series of U-shaped seats integrally connected in a circular configuration.

The multi-stone circular setting 10 in combination with gemstones or diamonds 12A, 12B, 12C, 12D, 12E, 12F and 12G seated therein is the preferred embodiment of the present invention and is represented in detail by FIGS. 1 through 5 of the patent drawings. The multi-stone circular setting 10 is used for an eternity band 10A (see FIG. 5) such that the plurality of diamonds 12A to 12G within the circular setting 10 provide the appearance of a single continuous diamond surface. The circular setting 10 is configured to hold and mount between seven (7) to thirty (30) gemstones or diamonds depending upon the size of the finger and the size, style, girth and configuration of the gemstones or diamonds being mounted within the setting 10 in order to maximize the visibility of the gemstones in the setting.

Each diamond 12A to 12G includes side walls 12*wa*, 12*wb*, 12*wc* and 12*wd*, corners 12*ca*, 12*cb*, 12*cc* and 12*cd*, and an upper surface 12*us* for seating the aforementioned diamonds within the circular setting 10.

As shown in FIGS. 1 to 5 of the drawings, the multi-stone circular setting 10 in combination with gemstones or diamonds 12A to 12G form an eternity band 10A which includes a plurality of U-shaped seats 20, 30, 40, 50, 60, 70 and 80 etc. being integrally connected together in a circular configuration C. Each of the U-shaped seats 20, 30, 40, 50, 60, 70 and 80 form a seating area 21, 31, 41, 51, 61, 71 and 81 for receiving and retaining a diamond or gemstone therein. Each of the U-shaped seats 20 to 80 includes an inner U-shaped member 22, 32, 42, 52, 62, 72 and 82 connected in series to form an inner wall 87, and an outer U-shaped member 24, 34, 44, 54, 64, 74 and 84 connected in series to form an outer wall 88. The number of seats can vary from eight (8) to twenty (20).

Figure 2:
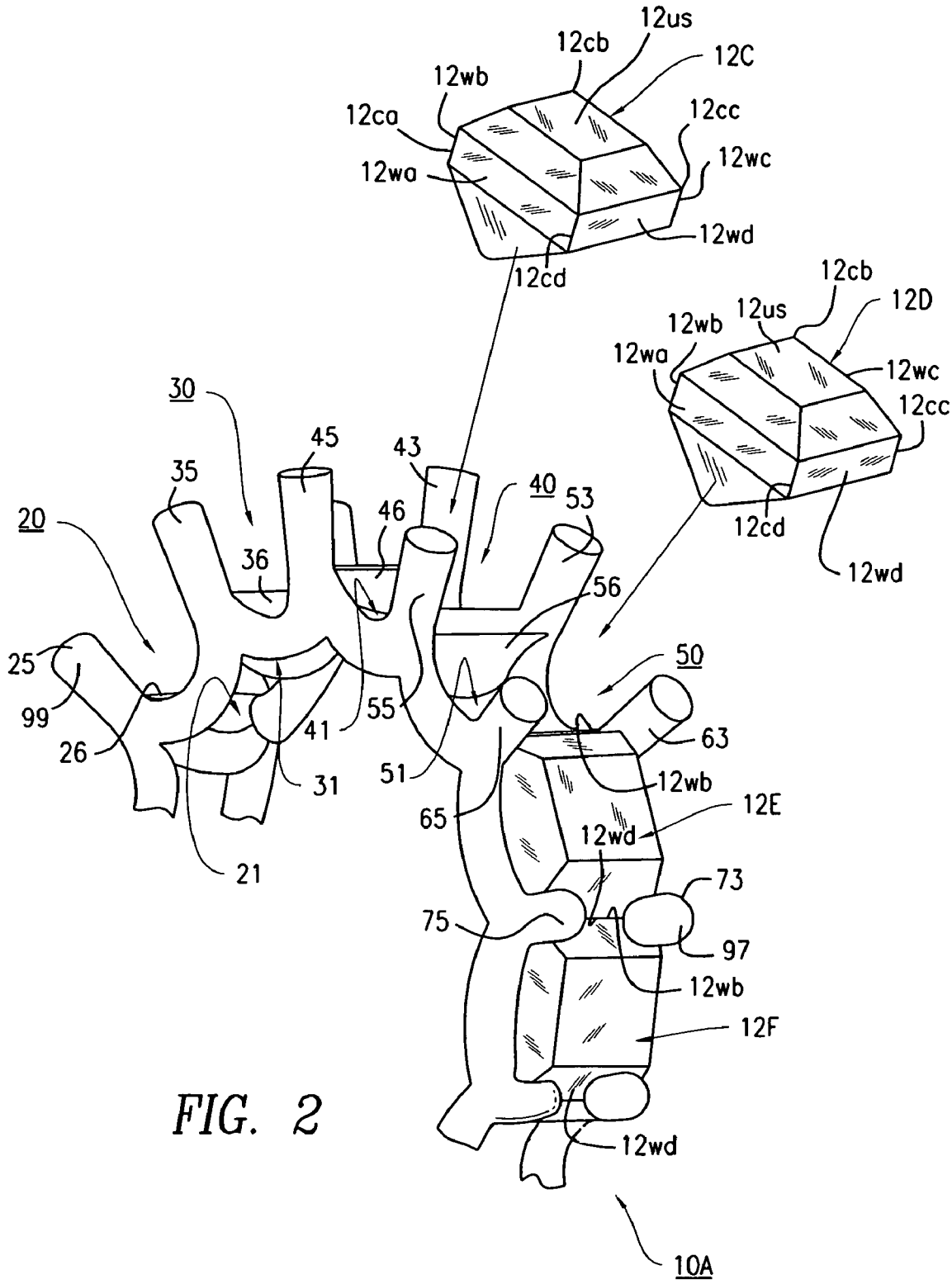
FIG. 2 is a partial perspective view of the multi-stone circular setting for an eternity band of the present invention showing a plurality of gemstones or diamonds being mounted within the series of U-shaped seats.
Figure 3:
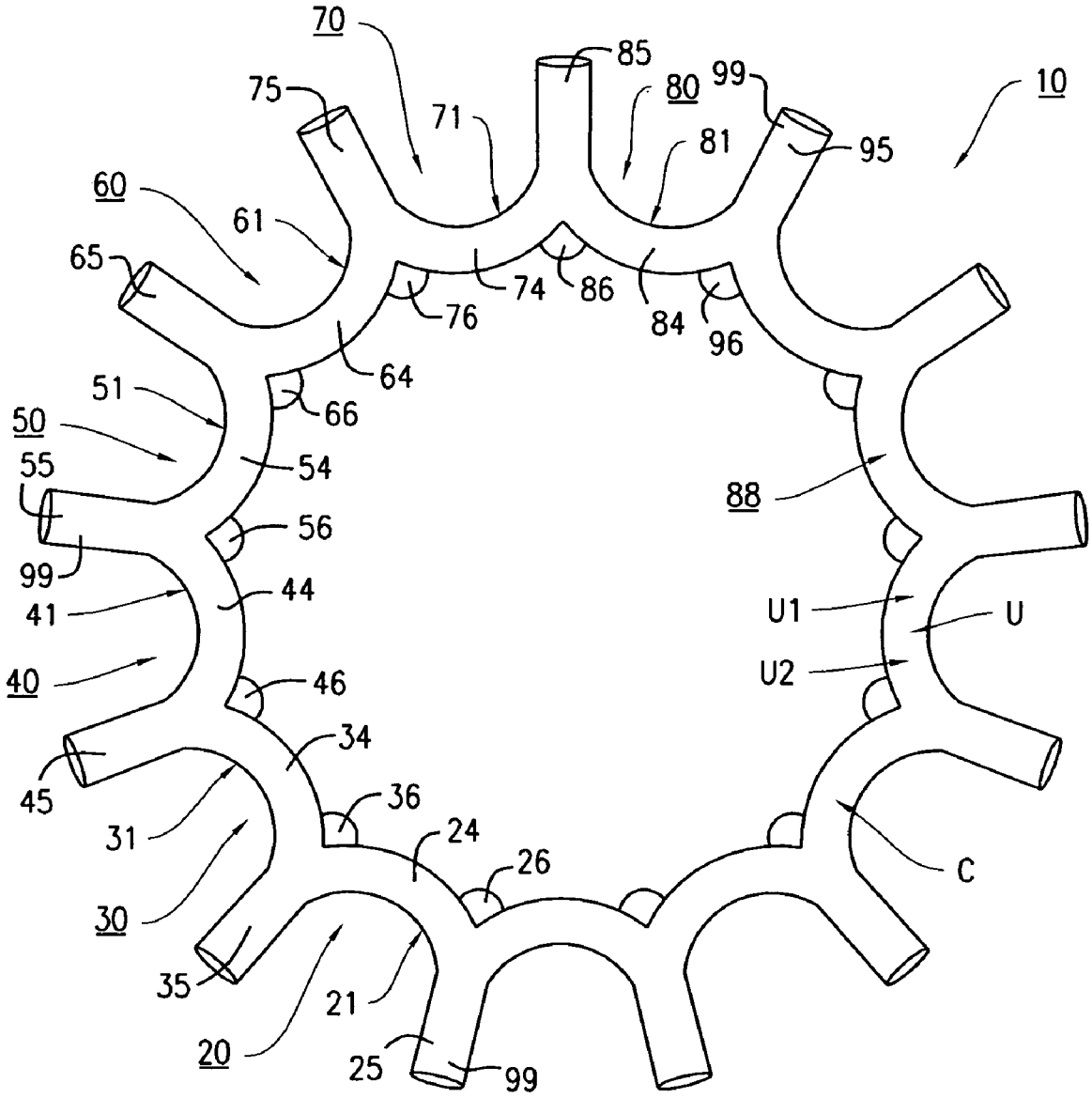
FIG. 3 is a side elevational view of the multi-stone circular setting for an eternity band of the present invention showing an outer ring of prongs thereon.
Figure 4:
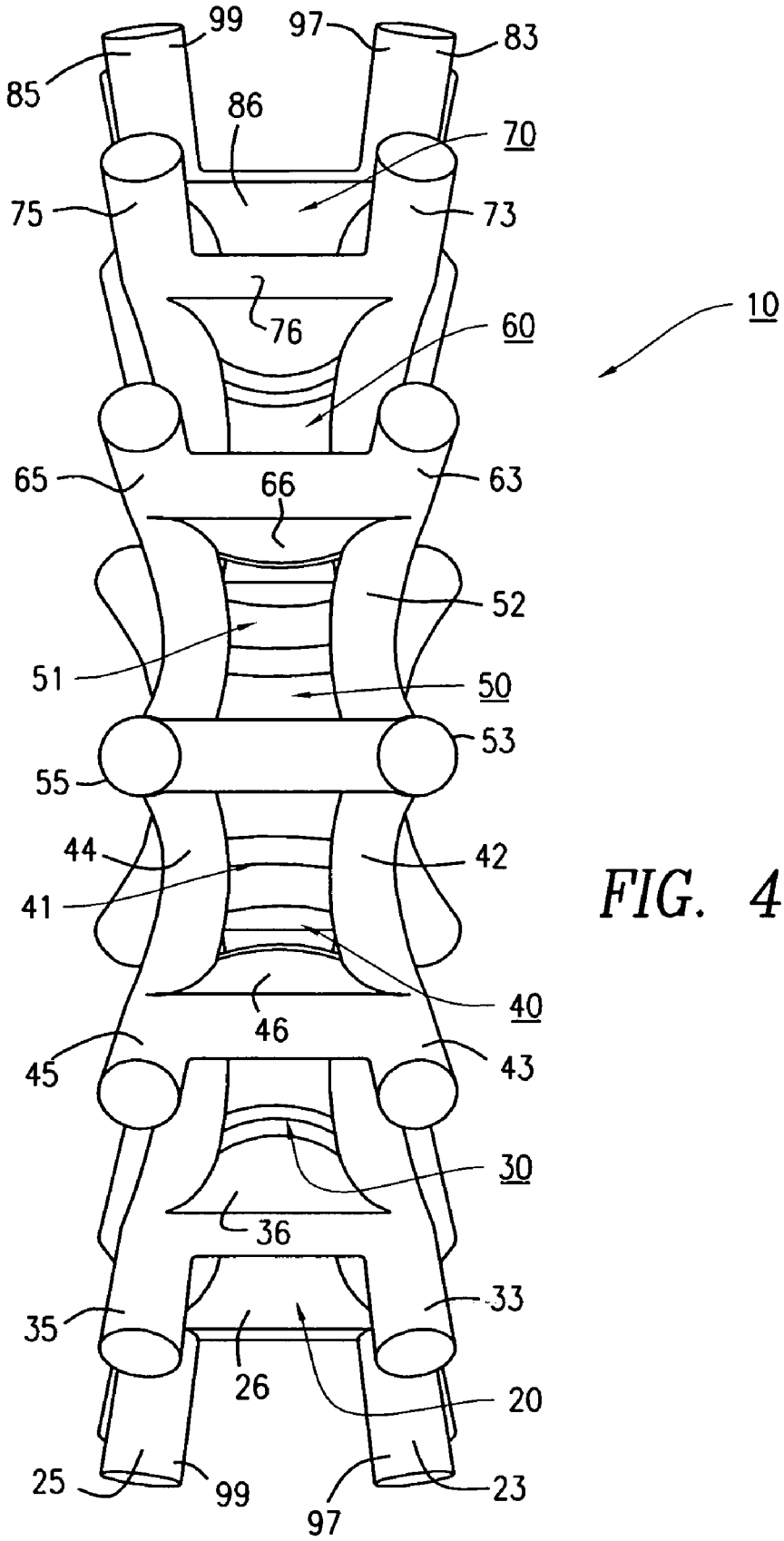
FIG. 4 is an end elevational view of the multi-stone circular setting for an eternity band of the present invention showing the configuration of the U-shaped seats and prongs.

The inner set of U-shaped members 22 to 82 each include two upstanding prongs 23 and 33; 33 and 43; 43 and 53; 53 and 63; 63 and 73; 73 and 83; and 83 and 93, respectively. The outer set of U-shaped members 24 to 84 each include two upstanding prongs 25 and 35; 35 and 45; 45 and 55; 55 and 65; 65 and 75; 75 and 85; and 85 and 95; respectively. Additionally, each of the inner and outer upstanding prongs 23 and 25; 33 and 35; 43 and 45; 53 and 55; 63 and 65; 73 and 75; and 83 and 85 are connected together by a transverse support bar 26, 36, 46, 56, 66, 76, 86, and 96, respectively, as shown in FIGS. 1 and 2 of the drawings. Each of the outer and inner U-shaped members 22 to 82 and 24 to 84 is formed having a U-shape configuration (designated by the reference "U") having curved bottom corners U1 and U2 and the upstanding prongs 23, 25, 33, 35, 43, 45, 53, 55, 63, 65, 73, 75, 83 and 85 each having an upper end 97 and 99, respectively, being bent inwardly to engage the side wall surfaces 12*wd* and 12*wb*; of adjacent gemstones, respectively.

In this manner, for example, U-shaped seat 50 is formed in the following manner. The adjacent U-shaped seat 40 to the left of U-shaped seat 50 has a set of prongs 43, 53, 45 and 55 and the adjacent U-shaped seat 60 to the right of U-shaped seat 50 has a set of prongs 63, 73, 65 and 75. Also, U-shaped seat 50 is formed by the set of prongs 53, 63, 55 and 65 so that prongs 53 and 55 are shared with adjacent U-shaped seat 40 and so that prongs 63 and 65 are shared with adjacent U-shaped seat 60, as shown in FIGS. 1 and 2 of the drawings.

The series of connected U-shaped seats 20 to 80 each receive a gemstone. Since four prongs are not used for each seat, and since each pair of prongs is shared by two adjacent seats, this allows the side wall surfaces of adjacent gemstones to touch or engage each other. In this manner, the novel setting of the present invention provides the appearance of a single continuous gemstone surface extending all the way around the eternity band. In addition, each of the U-shaped members 22 to 82 and 24 to 84 allows maximum visibility of the side of each gemstone, including the girdle, pavilion and culet of each gemstone.

It is understood that the multi-stone circular setting 10 for eternity band 10A can be made from precious metals such as gold, silver, platinum or palladium for setting precious gemstones, including diamonds, rubies, sapphires, emeralds and the like. It is also understood that the multi-stone circular setting 10 can vary in size depending upon the wearer's ring finger 14 size and the type of gemstone used, such as a round shape, an oval shape, a square shape, a rectangular shape, an emerald shape and the like.

OPERATION OF THE PRESENT INVENTION

Figure 5:
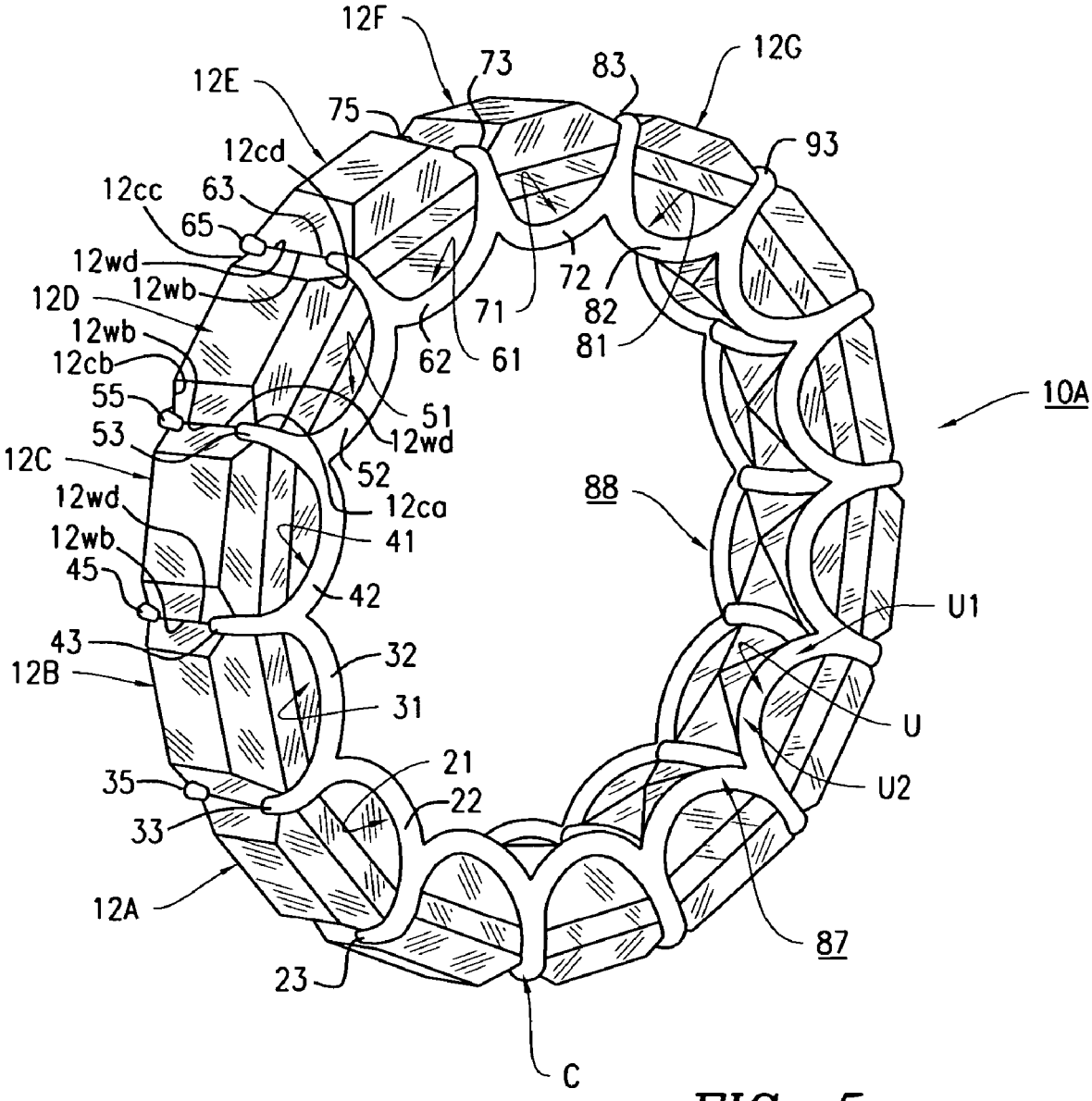
FIG. 5 is a front perspective view of the multi-stone circular setting for an eternity band of the present invention showing a diamond mounted within each of the series of U-shaped seats, to provide support for a row of gemstones, wherein the side walls of adjacent gemstones touch each other to provide the appearance of a single continuous gemstone surface.

The multi-stone circular setting 10 of the preferred embodiment of the present invention, as shown in FIGS. 1 and 5, is constructed by the jeweler initially placing the mounting bar member in a jewelry vise (not shown) for mounting of each of the diamonds 12A to 12G within each of the seating areas 21 to 81 of the U-shaped seats 20 to 80, respectively, of the circular setting 10 by the jeweler. The jeweler's initial steps are the placing and mounting of diamonds 12A to 12G within each of the seating areas 21, 31, 41, 51, 61, 71 and 81 of U-shaped seats 20, 30, 40, 50, 60, 70 and 80, respectively, of the circular setting 10, as shown in FIG. 2.

In each seating area, such as seating area 51, the gemstone is seated on adjacent transverse support bars 56 and 66 to support the gemstone 12D from below.

The jeweler then slightly bends inwardly, for example, upstanding prongs 53 and 63 and 55 and 65 of U-shaped seat 50, respectively, in order to seat diamond 12D within the seating area 51 of U-shaped seat 50, and they provide a downward holding force. Then prongs 53 and 63 share the side wall surfaces 12*wb* and 12*wd* and corners 12*cb* and 12*cc* of diamond 12D, as well as share the side wall surface 12*wd* and corner 12*cc* of diamond 12C, respectively. Correspondingly, prongs 55 and 65 share the side wall surfaces 12*wb* and 12*wd* and corners 12*ca* and 12*cd* of diamond 12D, as well as share the side wall surface 12*wb* and corners 12*ca* and 12*cb* of diamond 12E, respectively, as depicted in FIGS. 2 and 5 of the drawings. The aforementioned steps are repeated for all the diamonds being seated, in order to give the final appearance and configuration, as shown in FIG. 5.

ADVANTAGES OF THE PRESENT INVENTION

Accordingly, an advantage of the present invention is that it provides for a novel multi-stone circular setting for an eternity band which is used for holding and mounting a plurality of diamonds or gemstones within the setting.

Another advantage of the present invention is that it provides for a multi-stone circular setting for an eternity band that includes a series of connected U-shaped seats, each seat for mounting a separate diamond or gemstone, using shared prongs in order to minimize the support structure of the circular setting.

Another advantage of the present invention is that it provides for a multi-stone circular setting for an eternity band that can be made from precious metals such as gold, silver, platinum or palladium for setting precious gemstones, including diamonds, rubies, sapphires, emeralds and the like.

Another advantage of the present invention is that it provides for a multi-stone circular setting for an eternity band that can be produced in an economical manner and is readily affordable by the jewelry consumer.

A latitude of modification, change, and substitution is intended in the foregoing disclosure, and in some instances, some features of the invention will be employed-without a corresponding use of other features. Accordingly, it is appropriate that the appended claims be construed broadly and in a manner consistent with the spirit and scope of the invention herein.

What is claimed is:

1. An eternity band having a multi-stone circular setting in combination with gemstones or diamonds each having side wall surfaces, comprising:

a) a plurality of U-shaped seats being connected in series to form a circular configuration; each of said U-shaped seats form a seating area for receiving and mounting a gemstone;

b) each of said U-shaped seats include an inner U-shaped member and an outer U-shaped member;

c) a plurality of said inner U-shaped members being connected in series to form an inner wall; and a plurality of said outer U-shaped members being connected in series to form an outer wall;

d) each of said inner and outer U-shaped members having two upstanding prongs which are shared with the adjacent U-shaped seats for seating adjacent gemstones so the side wall surfaces of adjacent gemstones touch each other to provide the appearance of a single continuous gemstone surface extending all the way around the eternity band;

e) each of said inner and outer U-shaped members being connected by two spaced-apart transverse support bars on which each gemstone is seated in said seating area;

f) each of said inner and outer U-shaped members being formed by a lower support bar disposed at the bottom of said U-shaped members to form a plurality of viewing areas to allow the viewer to view the side wall surfaces of the seated gemstone which allows maximum visibility of the side of each gemstone, including the girdle, pavilion and culet of each gemstone; and g) each of said upstanding prongs having upper ends for engaging the side wall surfaces of two adjacent gemstones to keep said gemstones seated within said seating areas.

2. An eternity band having a multi-stone circular setting in accordance with claim 1, wherein each of said U-shaped members is formed as a U-shape having curved bottom corners and said upstanding prongs each having an upper end bent inwardly to engage the side wall surfaces of said adjacent gemstones.

3. An eternity band having a multi-stone circular setting in accordance with claim 1, wherein said plurality of U-shaped seats are configured to hold and mount between seven (7) to thirty (30) of said gemstones depending upon the size of the wearer's finger and the size, style, girth and configuration of said gemstones being mounted within said circular setting.

4. An eternity band having a multi-stone circular setting in accordance with claim 1, wherein said circular setting is made from gold, silver, platinum, palladium or other precious metals.

5. An eternity band having a multi-stone circular setting in accordance with claim 1, wherein said gemstone is selected from the group consisting of diamonds, rubies, sapphires, emeralds, and other precious gemstones.

6. An eternity band having a multi-stone circular setting in accordance with claim 1, wherein said seating area of said U-shaped seat is capable of mounting and retaining each gemstone having a round shape, a rectangular shape, a square shape, an oval shape, and other geometric shapes.

* * * * *